US006293283B1

(12) United States Patent
Washington

(10) Patent No.: US 6,293,283 B1
(45) **Date of Patent: *Sep. 25, 2001**

(54) APPARATUS AND METHOD FOR COVERING FINGERNAILS

(76) Inventor: Michele Washington, P.O. Box 83415, Phoenix, AZ (US) 85071

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 102 days.

(21) Appl. No.: 09/324,680

(22) Filed: Jun. 3, 1999

(51) Int. Cl.[7] ..... A45D 29/00; A45D 29/18

(52) U.S. Cl. ..... 132/73; 132/73.5; 132/285

(58) Field of Search ..... 132/200, 285, 132/73, 73.5, 75.3

(56) References Cited

U.S. PATENT DOCUMENTS

| | | | | |
|---|---|---|---|---|
| D. 295,451 | | 4/1988 | Mast | D28/56 |
| D. 314,727 | | 2/1991 | Samaras | D11/27 |
| D. 376,224 | | 12/1996 | Fojon | D28/56 |
| D. 384,440 | | 9/1997 | Meyerovich | D28/56 |
| 1,135,382 | | 4/1915 | Kindred . | |
| 1,942,332 | | 1/1934 | Hamberg . | |
| 2,234,657 | * | 3/1941 | Smaldone | 132/285 |
| 2,607,356 | | 8/1952 | Lewis . | |
| 2,746,460 | | 5/1956 | Jellinek . | |
| 2,799,282 | * | 7/1957 | Slack | 132/285 |
| 2,941,535 | | 6/1960 | Lappe . | |
| 3,487,831 | | 1/1970 | Jaume et al. . | |
| 3,502,088 | | 3/1970 | Jarby . | |
| 3,750,684 | | 8/1973 | Russell | 132/75.3 |
| 3,967,631 | | 7/1976 | Kosal | 132/73 |
| 3,993,084 | | 11/1976 | Cullen | 132/73 |
| 4,106,614 | | 8/1978 | Aylott | 206/45.14 |
| 4,625,740 | | 12/1986 | Roth | 132/73 |
| 4,632,134 | | 12/1986 | Reid | 132/73 |
| 4,751,935 | | 6/1988 | Mast et al. | 132/73 |
| 4,824,702 | | 4/1989 | Straub | 428/15 |
| 4,920,991 | | 5/1990 | Shibahashi et al. | 132/73 |
| 4,926,890 | | 5/1990 | Hoskins | 132/73 |
| 4,947,876 | | 8/1990 | Larsen | 132/73 |

(List continued on next page.)

FOREIGN PATENT DOCUMENTS

| | | | | |
|---|---|---|---|---|
| 725969 | * | 3/1955 | (DE) | 132/73 |
| 1.072.931 | | 9/1954 | (FR) . | |
| 81 11414 | | 12/1981 | (FR) . | |

*Primary Examiner*—John J. Wilson
*Assistant Examiner*—Robyn K Doan
(74) *Attorney, Agent, or Firm*—Schmeiser, Olsen & Watts

(57) ABSTRACT

A fingernail cover includes a decorative topper to fill the gap between the outgrown artificial fingernail and the cuticle of the underlying natural fingernail. The fingernail cover may also include a decorative sleeve to slip over the tip of the artificial fingernail. The fingernail cover may be used to conceal damaged fingernails, to maintain an attractive appearance of artificial nails without requiring application of nail polish, or to increase the strength of the artificial or natural fingernails. The fingernail cover may be fabricated from a material selected from among metal, gold, silver, other precious metals, metal electroplated with precious or other metal and colored injection molded plastic, particularly "neon" colors. Also, instead of sizing the decorative topper to fill the indicated gap, the topper may instead be sized to cover the gap. A method of covering an artificial fingernail includes growing out a natural fingernail underlying an artificial fingernail and filling the gap that forms with a decorative topper left exposed, thus eliminating the gap and enhancing the appearance of the finger. Also, the method may include a step of applying a decorative sleeve to the tip of the artificial fingernail. Further, such a decorative sleeve may be periodically removed, the grown out artificial fingernail trimmed back, and the sleeve reapplied to resume the original position prior to the fingernail growing out.

13 Claims, 2 Drawing Sheets

U.S. PATENT DOCUMENTS

| | | | |
|---|---|---|---|
| 4,960,138 | 10/1990 | Kling | 132/73 |
| 5,070,892 | 12/1991 | Trematerra | 132/73 |
| 5,121,760 | 6/1992 | Ward | 132/73 |
| 5,282,276 | 2/1994 | Preziose | 2/21 |
| 5,372,150 | 12/1994 | Hughes | 132/200 |
| 5,450,864 | 9/1995 | LaJoie et al. | 132/73 |
| 5,467,787 | 11/1995 | Mast et al. | 132/73 |
| 5,638,835 | 6/1997 | Franz et al. | 132/200 |
| 5,699,813 | 12/1997 | Carroll | 132/73 |
| 5,724,999 * | 3/1998 | Kim | 132/200 |
| 5,916,653 * | 6/1999 | Kunstadter et al. | 428/42.1 |
| 5,924,427 * | 7/1999 | Jensen | 132/73 |
| 5,928,457 * | 7/1999 | Engler | 132/73 |

* cited by examiner

APPARATUS AND METHOD FOR COVERING FINGERNAILS

RELATED APPLICATION

This application is related to a copending design patent application by Michele Washington entitled "FINGERNAIL ENHANCEMENTS", Ser. No. 29/105812 filed , Jun. 3, 1999 that is incorporated herein by reference.

BACKGROUND OF THE INVENTION

1. Technical Field

This invention relates to the field of artificial fingernails. More specifically, the invention relates to covers for artificial fingernails and methods for covering an artificial fingernail.

2. Background Art

Artificial fingernails and other fingernail ornamentation is widely used in the modern world. There are a variety of reasons for which a person may choose to wear artificial fingernails or other fingernail ornamentation, such as fingernail polish. However, chief among the variety of reasons is to improve the aesthetic appearance of one's hands. Many people go to great lengths and expense to obtain a neatly manicured appearance for their fingernails. Although it is possible to manicure and trim natural fingernails, some people suffer from nails that are too thin or too brittle to consistently maintain an attractive appearance. Also, still other people have fingernails that may be permanently damaged, deformed, or discolored, such that conventional manicuring does not achieve the desired appearance. Accordingly, such people, as well as others, turn to applying artificial fingernails to their natural fingernails.

By applying artificial fingernails to natural fingernails, there is generally little worry regarding the thickness, brittleness, deformities, or discoloration of the natural fingernails. Numerous artificial fingernails exist for consumers to select from a wide variety shapes, colors, materials, and textures. Also, it is well known among many people how to apply their own artificial fingernails. Even so, professional manicurists and other individuals trained in applying artificial fingernails exist to assist those who lack the expertise or time to apply their own artificial fingernails. Unfortunately, routine visits to such professionals may be required every couple of weeks or so to maintain the desired appearance of even artificial fingernails. These routine visits are most often needed because the natural fingernail to which the artificial fingernail is adhered continues to grow after the artificial fingernail is applied. Thus, because the artificial fingernail is adhered to the surface of the natural fingernail, a gap typically develops between the artificial fingernail and cuticle of the natural fingernail as the natural fingernail grows out. The gap is typically considered to detract from the appearance of quality artificial fingernails.

One conventional method used to remedy the unsightly gap thus formed involves applying an adhesive to the natural fingernail where exposed through the newly formed gap. While the adhesive is still wet, the natural fingernail is dipped into a fine powder designed to partially fill the gap. A new coating of adhesive is applied to the powder that sticks to the first coat of adhesive and dipping in powder is repeated. This method, though tedious, successfully thickens the fill material in the gap. Once the gap is sufficiently filled using the repetitive process, the gap filler may be filed smooth and nail polish applied to conceal the presence of the gap filler. Thus, it is a problem with the current technology that the gap filler may of itself create an unsightly appearance and require routine applications of nail polish to conceal the gap filler.

Often, filling of a gap by such method and application of nail polish will require frequent routine visits to a nail professional such as those described above. Accordingly, there exists a need to provide a way to fill gaps that form as artificial nails grow out in a simple manner that does not require a visit to a nail professional. There is also a need to provide a way to maintain an attractive appearance of the artificial nails without requiring application of nail polish.

DISCLOSURE OF INVENTION

According to the present invention, a fingernail cover is provided, comprising a decorative topper sized to conceal a gap between an outgrown artificial fingernail and a cuticle of a natural fingernail on which the artificial fingernail is mounted. By way of example, the decorative topper may be sized to substantially fill the gap or to substantially cover the gap. The fingernail cover may also include a decorative sleeve sized to receive at least a part of a tip of the artificial fingernail. Also, the sleeve and topper may be separate, forming a two-piece fingernail cover, or may be portions of a one-piece fingernail cover. Further, a few examples of materials for fabricating the described fingernail covers includes metal, gold, silver, other precious metals, metal electroplated with precious or other metal, and colored injection molded plastic.

Also according to the present invention, a method of covering an artificial fingernail is provided, comprising the steps of:

allowing a natural fingernail on which the artificial fingernail is mounted to grow out, forming a gap between the artificial fingernail and the cuticle of the natural fingernail;

substantially concealing the gap with a decorative topper; and leaving the decorative topper exposed.

By way of example, the step of concealing the gap may include substantially filling the gap or substantially covering the gap. The steps of the above method may be repeated to successively add another decorative topper to cover each new gap formed as the natural fingernail grows out. Further, the method may also include the step of inserting at least a part of a tip of the artificial fingernail into a decorative sleeve sized to receive it. Such a decorative sleeve may be periodically removed in a method according to the present invention, the grown out nail trimmed back, and the sleeve reapplied along with the fingernail cover to resume the position prior to the fingernail growing out.

The foregoing and other features and advantages of the present invention will be apparent from the following more particular description of preferred embodiments of the invention, as illustrated in the accompanying drawings.

BRIEF DESCRIPTION OF DRAWINGS

Preferred embodiments of the present invention will hereinafter be described in conjunction with the appended drawings, where like designations denote like elements, and.

BEST MODE FOR CARRYING OUT THE INVENTION

According to a preferred embodiment of the present invention, a fingernail cover is provided that includes a decorative sleeve to slip over the tip of an outgrown artificial fingernail and a decorative topper to fill the gap between the outgrown artificial fingernail and the cuticle of the underlying natural fingernail. With such an apparatus, the time between visits to a nail professional or re-application of artificial fingernails may be extended. Additionally, the fingernail cover may be used to conceal damaged fingernails or to maintain an attractive appearance of the artificial nails without requiring application of nail polish. Also, as alternative preferred embodiments, the sleeve and topper may be separate, forming a two-piece fingernail cover, or may be portions of a one-piece fingernail cover. Further, more preferably, the described fingernail covers are fabricated from a material selected from among metal, gold, silver, other precious metals, metal electroplated with precious or other metal and colored injection molded plastic, particularly "neon" colors. Also, as another alternative preferred embodiment, instead of sizing the decorative topper to fill the indicated gap, the topper may instead be sized to substantially cover the gap indicated between the artificial fingernail and the cuticle.

According to another preferred embodiment of the present invention, a method of covering an artificial fingernail is provided wherein, first, a natural fingernail underlying an artificial fingernail is grown out, forming a gap between the artificial fingernail and the cuticle of the natural fingernail. Next, the gap is filled with a decorative topper sized accordingly left exposed to both eliminate the gap and additionally enhance the appearance of the finger. Also, the method preferably includes a step of applying a decorative sleeve as described above to the tip of the artificial fingernail. More preferably, such a decorative sleeve is periodically removed, the grown out artificial fingernail is trimmed back, and the sleeve is reapplied to resume the original position prior to the fingernail growing out.

Figure 1:
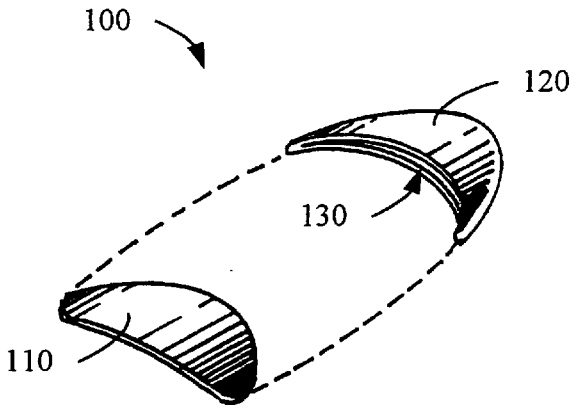
FIGS. 1 to 6 are each perspective views of a fingernail cover according to a preferred embodiment of the present invention.

Referring to FIGS. 1 to 6, various embodiments of the present invention are shown. In FIG. 1, a perspective view of a fingernail cover 100 is shown. Fingernail cover 100 includes a topper 110 and a sleeve 120, having a sleeve opening 130. Sleeve 120 is preferably sized to receive at least a part of a tip of an artificial fingernail, or alternatively a natural fingernail. Also, sleeve 120 is preferably shaped in a decorative manner to provide an aesthetically pleasing appearance and is preferably manufactured from a decorative material, such as the materials and electroplated metals mentioned above. Topper 110 is preferably sized to substantially fill the gap that forms between an artificial fingernail and the cuticle of a natural fingernail as the artificial fingernail grows out and is preferably manufactured from a decorative material similar to that described for sleeve 120. Sleeve 120 and topper 110 may also be manufactured from different materials selected among those indicated to add to the ornamental variety of fingernail cover 100. Further, the material for sleeve 120, in particular, may be selected on the basis of the additional strength it will provided to the underlying natural or artificial fingernail.

Accordingly, fingernail cover 100 provides at least three significant advantages over conventional artificial fingernails, fingernail decorations such as fingernail polish, and methods for providing attractive fingernails. In particular, topper 110 may be inserted into the gap formed at the base of an outgrown artificial fingernail to substantially extend the time between visits to a professional manicurist or to reduce the time spent by an individual on removing and reapplying artificial fingernails as they grow out. Because topper 110 is specifically designated as a decorative element of fingernail 100, there is no need to attempt to conceal topper 110 after it is used to fill the gap. This is an additional advantage to topper 110, since conventional gap filling powders must be covered or otherwise concealed after application to avoid an unappealing appearance. Further, topper 110 may be used as a decorative element of fingernail cover 100, even if there is no gap filling needed. Finally, sleeve 120 may be used as a strengthening addition to a natural or artificial fingernail. Notably, although not shown in the figures and not preferred, topper 110 may be used by itself to fill the gap and to improve the decorative appearance.

Because sleeve 120 and topper 110 are separate, FIG. 1 provides an example of a two-piece fingernail cover. Topper 110 and sleeve 120 are preferably adhered to an underlying artificial or natural fingernail using such adhesives as are typically used among those skilled in the pertinent art. Such adhesives are generally available from suppliers of artificial fingernails.

Figure 2:
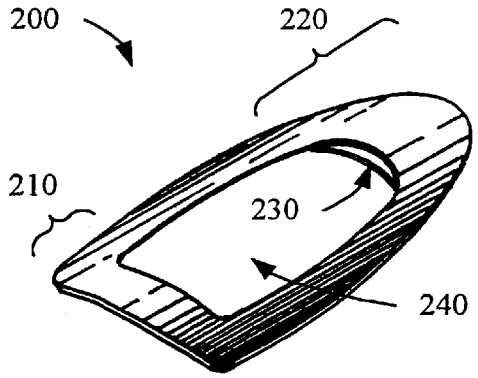

FIG. 2 shows an alternative fingernail cover 200 according to a preferred embodiment of the present invention. A part of fingernail 200 is designated as a topper portion 210 and a part is designated as a sleeve portion 220, having a sleeve opening 230 for insertion of a fingernail tip. Also, fingernail cover 200 includes a cut out 240 through which the underlying artificial nail or natural nail may be viewed after application of fingernail cover 200. Because topper portion 210 and sleeve portion 220 are included together in the same fingernail cover 200, FIG. 2 is exemplary of a one-piece fingernail cover. Notably, topper portion 210 may operate to perform the same function as topper 110 shown in FIG. 1 or it may alternatively be used to only cover the gap formed between an outgrown artificial nail and the natural fingernail cuticle.

To operate as a gap filler, it may be advisable to provide a topper, such as topper 110 shown in FIG. 1, adhered to the underside of topper portion 210. When fingernail cover 200 is applied to an artificial fingernail, the topper (not shown) adhered to the underside of topper portion 210 may be used to fill gaps between the artificial fingernail and cuticle. Also, topper portion 210 may be fabricated so as to be somewhat more thick than other parts of fingernail cover 200, thus accomplishing the same effect. Alternatively, fingernail cover 200 may be manufactured from a sufficiently flexible material to conform to the surface of the artificial fingernail and bend downward at the base of the artificial fingernail to at least partially fill any gap. Further, fingernail cover 200 may alternatively be fabricated from a sufficiently rigid material such that it covers the gap between the artificial fingernail and cuticle. If fingernail cover 200 is used as a cover, rather than filler, then an air gap would exist underneath topper portion 110. However, fingernail cover 200 would nevertheless accomplish its objective of extending the time between visits to a professional manicurist or self-application of new artificial fingernails or conventional powdered gap fillers.

Figure 3:
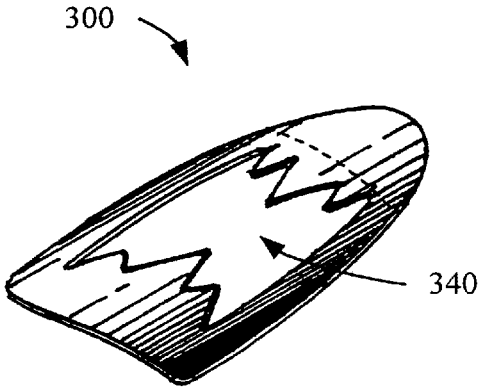

As an even further alternative, fingernail cover 300 is shown in FIG. 3 with an alternative cutout 340 taken from the central part of fingernail cover 300 through which the underlying fingernail may be viewed. Otherwise, fingernail cover 300 may include the same alternatives as indicated for fingernail 200 and provides the same features and advantages of fingernail cover 200.

Figure 4:
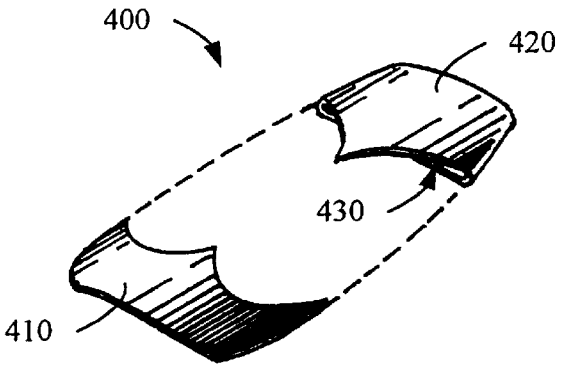

Turning now to FIG. 4, a fingernail cover 400 is shown that is similar in some respects to fingernail cover 100 but similar in other respects to fingernail cover 200 or 300. Fingernail cover 400 is similar to fingernail cover 100 in that it is a two-piece fingernail cover with a topper 410 and a sleeve 420, having a sleeve opening 430 for insertion of the tip of a fingernail. Notably, the shape of sleeve 420 is designed for a differently shaped fingernail tip than shown in FIG. 1 for sleeve 120. According to the present invention, the various sleeves or sleeve portions may be designed to adapt to a variety of differently shaped fingernails. The sleeves or sleeve portions could even be shaped different than the tip of the underlying artificial or natural fingernail that is covered by the sleeve or sleeve portion.. Sleeve 420 also includes a design feature that adds another decorative element to fingernail cover 400, namely, the curved outline that forms a peak at the center of the fingernail. A variety of design features may be used in the present invention to increase the decorativeness of any of the described fingernail covers.

Even though topper 410 is separate from sleeve 420, as shown for topper 110 in FIG. 1, topper 410 is not sized to fill a gap. Accordingly, the same requirements and alternatives discussed above for topper portion 210 in FIG. 2 is applicable to topper 410. That is, topper 410 may include another topper attached underneath topper 410 and sized to be a gap filler, may be more thick in selected regions, may be formed from a rigid material to cover the gap, or be formed from a flexible material to conform to the surface of the underlying natural fingernail and artificial fingernail. Otherwise, the discussion above is applicable to fingernail cover 400, for example, in regards to the material of construction, among other things.

Figure 5:
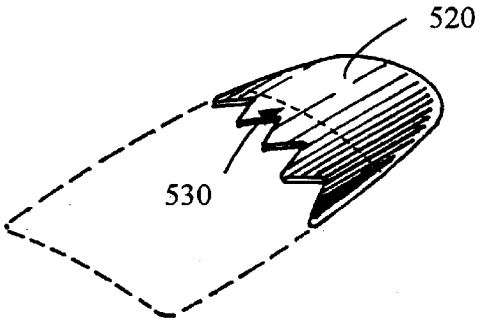
Figure 6:
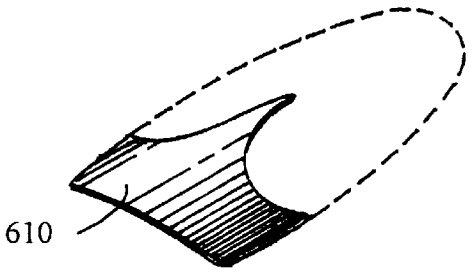

Turning now to FIG. 5, a fingernail 500 is shown including only sleeve 520, having sleeve opening 430. Accordingly, sleeve 520 may be used in conjunction with topper 410 or topper 110 to practice the preferred embodiments of the present invention, or an alternative topper (not shown) may be used. FIG. 6 shows a fingernail cover 600 including only topper 610, somewhat similar to topper 410 in FIG. 4. Unlike sleeve 520, topper 610 may be used by itself to practice the present invention. Topper 610 possesses several similarities to topper 410, but is different in that a slightly different shape is used for its design. Otherwise, the same features and advantages discussed for topper 410 are applicable to topper 610.

According to a preferred embodiment of the present invention a method is also provided for covering an artificial fingernail. The preferred method includes first allowing a natural fingernail on which an artificial fingernail is mounted to grow out, forming a gap between the artificial fingernail and the cuticle of the natural fingernail. Next, steps are taken to fill the gap and to produce a decorative appearance for the fingers. Specifically, a decorative topper sized to substantially fill the gap is adhered to the underlying natural nail with adhesive, or another suitable substance as known to those skilled in the art. At this point, the topper, such as topper 110 in FIG. 1, is left in place as a decorative feature. This is contrary to the practice involving powdered gap fillers, wherein such conventional gap fillers must be covered to avoid an unsightly appearance. Preferably, the method further comprises the steps of allowing the natural fingernail to grow out, leaving a new gap between the decorative topper and the cuticle of the natural fingernail and substantially filling the new gap with another decorative topper sized accordingly. However, as an alternative to adding new decorative toppers, another option is available when using a fingernail cover such as that shown in FIGS. 2 and 3. Namely, once a new gap is formed between a one-piece fingernail cover and the cuticle of the natural fingernail, the fingernail cover may be removed and the artificial fingernail trimmed back such that the one-piece fingernail may be reapplied to at least partially fill the new gap. In removing the decorative topper or decorative sleeve, any of the typical solvents used to dissolve the type of adhesives for applying artificial fingernails may be used to dissolve the adhesive for applying the fingernail covers of the present invention. Care may need to be exercised to avoid loosening the artificial fingernail when removing the fingernail cover. Accordingly, different adhesives may be advisable to be used for the fingernail and the fingernail cover, or alternatively solvent could be applied only to the fingernail cover.

Regarding how much of the fingernail tip fits into the sleeve, it is preferable that the underside of the artificial fingernail or natural nail does not show after the sleeve is applied. Also, it should be pointed out that fingernail covers according to the present invention may be used to strengthen weak natural nails as an alternative to applying artificial fingernails.

While the invention has been particularly shown and described with reference to preferred embodiments thereof, it will be understood by those skilled in the art that various changes in form and details may be made therein without departing from the spirit and scope of the invention. Accordingly, unless otherwise specified, any dimensions of the apparatus indicated in the drawings or herein are given as an example of possible dimensions and not as a limitation. Similarly, unless otherwise specified, any sequence of steps of the method indicated in the drawings or herein are given as an example of a possible sequence and not as a limitation.

What is claimed is:

1. A method of covering an artificial fingernail, comprising the steps of:

allowing a natural fingernail on which the artificial fingernail is mounted to grow out, forming a gap between the artificial fingernail and the cuticle of the natural fingernail;

concealing the gap with a rigid decorative topper, wherein the rigid decorative topper covers the gap between the artificial fingernail and cuticle; and leaving the rigid decorative topper exposed.

2. The method of claim 1, further comprising the steps of:

allowing the natural fingernail to grow out further, leaving a new gap between the rigid decorative topper and the cuticle of the natural fingernail; and concealing the new gap with another rigid decorative topper, wherein the new rigid decorative topper covers the gap between the artificial fingernail and cuticle.

3. The method of claim 1, further comprising the step of inserting at least a part of a tip of the artificial fingernail into a sleeve opening of a separate decorative sleeve, the sleeve opening sized to receive the at least a part of the tip, wherein the separate decorative sleeve and the rigid decorative topper form a two-piece fingernail cover.

4. The method of claim 1, further comprising the steps of:

allowing the natural fingernail to grow out further, leaving a new gap between the one-piece fingernail cover and the cuticle of the natural fingernail;

removing the rigid fingernail cover;

trimming back the artificial fingernail;

concealing the new gap with another rigid decorative topper, wherein the new rigid decorative topper covers the new gap between the artificial fingernail and cuticle.

5. A fingernail cover, comprising a decorative topper sized to conceal a gap between an outgrown artificial fingernail and a cuticle of a natural fingernail on which the artificial fingernail is mounted; and a decorative sleeve sized to receive at least a part of a tip of the artificial fingernail, wherein the sleeve and topper are portions of a one-piece fingernail cover.

6. The fingernail cover of claim 5, wherein the decorative topper is sized to substantially fill the gap.

7. The fingernail cover of claim 5, wherein the decorative topper is sized to substantially cover the gap.

8. The fingernail cover of claim 5, wherein the fingernail cover is fabricated from a material selected from among metal, gold, silver, precious metals, metal electroplated with precious or other metal, and colored injection molded plastic.

9. A method of covering an artificial fingernail, comprising the steps of:

allowing a natural fingernail on which the artificial fingernail is mounted to grow out, forming a gap between the artificial fingernail and the cuticle of the natural fingernail;

substantially concealing the gap with a decorative topper; leaving the decorative topper exposed; and inserting at least a part of a tip of the artificial fingernail into a decorative sleeve sized to receive it, wherein the sleeve and topper are portion of a one-piece fingernail cover.

10. The method of claim 9, wherein the step of concealing the gap comprises substantially filling the gap with a decorative topper.

11. The method of claim 9, wherein the step of concealing the gap comprises substantially covering the gap with a decorative topper.

12. The method of claim 9, further comprising the steps of:

allowing the natural fingernail to grow out further, leaving a new gap between the decorative topper and the cuticle of the natural fingernail; and substantially concealing the new gap with another decorative topper.

13. The method of claim 1, further comprising the steps of:

allowing the natural fingernail to grow out further, leaving a new gap between the one-piece fingernail cover and the cuticle of the natural fingernail;

removing the fingernail cover;

trimming back the artificial fingernail; and reapplying the one-piece fingernail cover to at least partially conceal the new gap.

* * * * *